United States Patent [19]

Willenbacher et al.

[11] 4,423,690

[45] Jan. 3, 1984

[54] SEWING MACHINE FOR PRODUCING CURVED EDGE PARALLEL SEAMS

[75] Inventors: Erich Willenbacher, Kaiserlautern; Fritz Jehle, Enkenbach-Alsenborn, both of Fed. Rep. of Germany

[73] Assignee: Pfaff Industriemaschinen GmbH, Fed. Rep. of Germany

[21] Appl. No.: 328,504

[22] Filed: Dec. 8, 1981

[30] Foreign Application Priority Data

Dec. 20, 1980 [DE] Fed. Rep. of Germany ..... 3048198

[51] Int. Cl.[3] ..... D05B 97/00; D05B 35/10

[52] U.S. Cl. ..... 112/262.3; 112/153; 112/308

[58] Field of Search ..... 112/262.3, 262.1, 308, 112/309, 153, 136, 121.11, 121.12

[56] References Cited

U.S. PATENT DOCUMENTS 3,970,017 7/1976 Babson et al. ..... 112/121.12
4,100,864 7/1978 Babson et al. ..... 112/153 X
4,135,460 1/1979 Boitteau ..... 112/308 X
4,296,700 10/1981 Jehle et al. ..... 112/153
4,312,286 1/1982 Boitteau ..... 112/308

*Primary Examiner*—H. Hampton Hunter
*Attorney, Agent, or Firm*—McGlew and Tuttle

[57] ABSTRACT

A sewing machine with guide mechanism for automatically producing a curved edge parallel seam comprises a scanning unit for scanning the edge of a workpiece and sensing when the edge of the workpiece moves away from an edge guide which indicates the presence of a curved edge, a workpiece feeder for feeding the workpiece along the guide edge, a workpiece pressure stamp for applying pressure on the workpiece at a point spaced from the guide to cause rotation of the workpiece about the point when the pressure stamp is activated and a circuit connected between the scanning unit and the pressure stamp for intermittently activating the pressure stamp when the scanner senses the presence of a curved edge area of the workpiece.

12 Claims, 4 Drawing Figures

SEWING MACHINE FOR PRODUCING CURVED EDGE PARALLEL SEAMS

FIELD AND BACKGROUND OF THE INVENTION

This invention relates in general to sewing machines and in particular to a new and useful guide mechanism for a sewing machine which aids in the automatic production of curved seams that are parallel to the curved edge of material carrying the seams.

A sewing machine is known from German Patent No. 25 22 422 for the automatic production of curved edge parallel seams where a guide arm is arranged on one side of the needle and a pressure stamp is on the opposite side of the needle. The driving mechanism of the pressure stamp is a pneumatic cylinder which is controlled, over a solenoid valve, by a device for scanning the edge of the sewing material in the outer curved region that deviates from a straight line. The cylinder is activated in order to lower the pressure stamp onto the sewing material for the production of a curved edge parallel seam, at a lateral distance from the needle, and to press the material on its bearing surface to produce a braking force. The sewing material is turned by the continuing cloth feed, about the pressure stamp, at an axis of rotation corresponding to the course of the edge. The pressure must be so great that the narrowest arc on a workpiece can still be exactly controlled to obtain an edge-parallel seam. But this has the result that the edge-parallel control of all arcs with a larger radius of curvature is no longer possible or only possible with very stiff materials. The distance of the guide arm from the needle must correspond to the desired distance of the seam from the edge of the sewing material, which results from the narrowest arc of the contour of the sewing material. Likewise the distance to the touch-down point of the pressure stamp from the needle must correspond to the narrowest arc of the sewing material curved edge.

Since the touch-down point of the pressure stamp is with all larger arcs outside the center of the radius of curvature, the pressure of the pressure stamp can only be overcome in very stiff materials by the reaction force acting on the sewing material when its lateral edge is pushed toward the guide arm during its rotation so that the sewing material is moved under the pressure stamp transversely to the direction of feed away from the guide arm. Consequently arcs with a larger radius of curvature can only be controlled in an edge-parallel manner, in very stiff sewing materials.

In order to improve the material rotation and feed control, it has already been suggested (German OS No. 27 16 914) to control the force acting on the pressure stamp in dependence on the size of the radius of curvature in such a way that it increases with a decreasing radius of curvature. But even with this type of contour control it is not possible to obtain a contour-correct edge-parallel seam in soft materials because the inherent stiffness of the material is not sufficient to transform the force acting as a torque, with the pressure stamp attached, and the cloth feed continuing to work, with which the material is pushed with its lateral edge during its rotation about the pressure stamp against the guide arm, partly away from the guide arm for transverse displacement under the pressure stamp, so that it acts on the sewing material. Because of the low inherent stiffness, the edge zone of the sewing material pushed during the rotation against the guide arm yields upwardly on the guide arm. It is thus raised and frequently even rolled upwardly.

In the area of the arcs with a radius which is greater than the smallest radius of curvature this results in a different distance of the seam from the lateral edge than the distance from a straight course of the edge or at the narrowest arc of the sewing material. In bordering, the upwardly rolled edge zones are enveloped by the bordering ribbon and sewn in. The outer contour of the sewing material is thus partly considered falsified. In shoe patterns, which have practically always a special design effect due to the outer shape which must orient itself to the shape of the human foot, this can lead to a complete failure of the action intended with the design of a pattern and to a considerable deterioration of the fitting form.

SUMMARY OF THE INVENTION

Accordingly an object of the present invention is to provide a mechanism for forming curved edge parallel seams, in an automatic manner, which can form such seams in all materials including materials of low inherent stiffness, and wherein the accuracy of the curved edge parallel seam can be controlled.

Another object of the invention is to provide such an accurate control by intermittently activating a pressure stamp which presses down on a material to be sewn to cause an edge of the material to rotate about the pressure point by a selected amount but only during the period that the pressure stamp is activated.

The intermittent drive of the pressure stamp ensures that the sewing material is admitted in rapid succession with braking force pulses and is turned by the continuing cloth feed in small angular amounts, while its pressure is relieved in the intervals between two pressure phases and therefore can yield away from the guide arm transversely to the direction of feed, to the extent that it is displaced with its lateral edge toward the guide arm, without having to overcome the resistance of the pressure stamp. In this way the sewing material constantly corrects its position relative the guide arm and permits the sewing of an absolutely contour-correct edge-parallel seam, independent of the radius of curvature of the outer arcs of the sewing material edge.

A particularly good adaptation of the aligning movement and of the yielding movement for correcting the position of the sewing material results from another feature of the invention. According to this other feature a further object of the invention is to provide the pressure stamp to have a movement which can be controlled with respect to the angular position of the main shaft of the sewing machine.

Another object of the invention is to provide for the activation of the pressure stamp substantially during a phase of feeding for the cloth.

According to another inventive feature, it is of advantage to use, as a driving mechanism for the pressure stamp, a preferably adjustable pulse generator. This can be of a pneumatic or electrical type.

Another object of the invention is to provide a mechanism whereby the braking force of the pressure stamp can be adjusted by varying the initial stress of a spring arranged on a piston rod of a compressed air cylinder controlling the pressure stamp.

In order to be able to handle, with equally good results, sewing material that is particularly sensitive to pressure, it is possible according to the invention, to use a pulsating air current to produce the braking force.

A further object of the invention is to provide a mechanism for automatically producing curved edge-parallel seams which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF PREFERRED EMBODIMENTS

Figure 1:
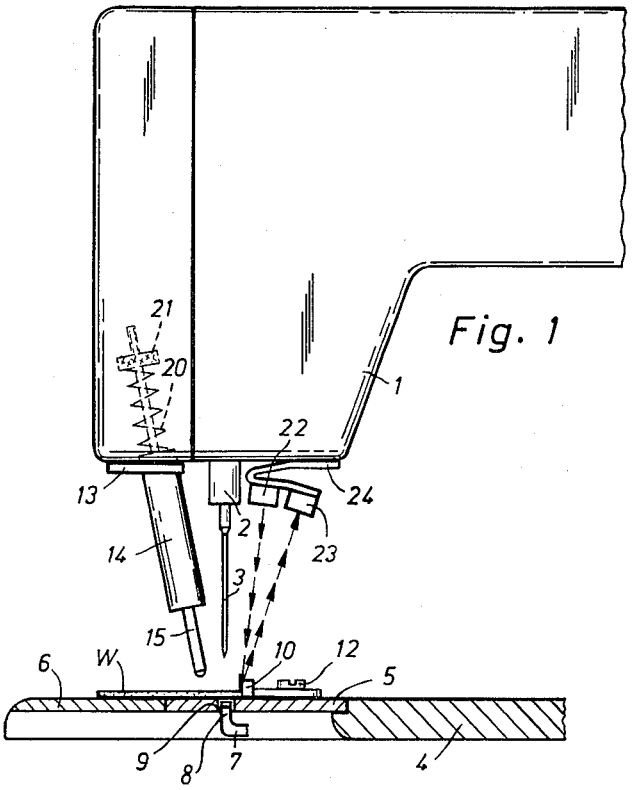
FIG. 1 is a side elevational view, in a simplified form, showing the head region of a sewing machine where the cloth presser has been omitted for clarity.

Turning to the drawings in particular, the invention embodied therein in FIG. 1 comprises a guide mechanism for a sewing machine having a head portion 1, for automatically producing edge-parallel curved seams by intermittently activating a cylinder 14 to intermittently press a pressure stamp 15 down against work material W, while the work material continues to be fed by a cloth feeder (7) so that an edge of the material is forced to turn around the pressure point of the pressure stamp and form a small portion of an arc of the finished curved seam area. The cylinder 14 is operated only intermittently and for short periods so that the material, regardless of its lack of stiffness, will accurately form into a curved outer contour without distortion.

Figure 2:
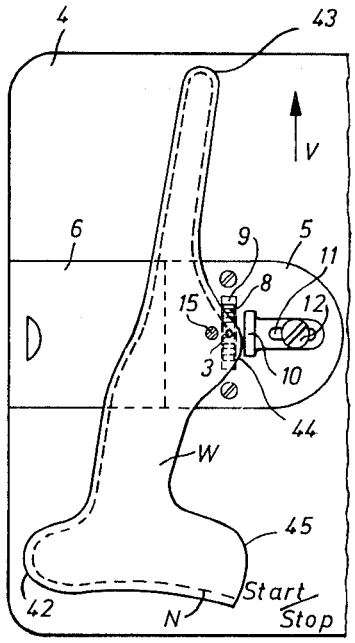
FIG. 2 is a top plan view of a workpiece on a work support area of the sewing machine and the guide arm for its contour edge.

An ascending and descending needle bar 2 is mounted in the sewing machine head 1, which carries, at its bottom end, the thread-carrying needle 3. The needle cooperates with a looper (not shown) arranged under a throat plate 5 and secured in work support plate 4 for forming the seam. The looper is accessible by retracting a work support plate slide 6. For feeding workpiece W, needle bar 2 performs, together with the cloth feeder 7 which performs a rectangular movement in known manner, a movement in a feeding direction shown at arrow V in FIG. 2. The toothed web 8 of the cloth feeder passes upwardly through a slot 9 in throat plate 5 for the feeding movement during a feeding phase, to act on workpiece W. A guide arm 10 is provided for guiding workpiece W on one side of needle 3, which is secured by means of a screw passing through an oblong slot 11 on throat plate 5. The distance of guide arm 10 from needle 3 is adjustable to set the distance between the workpiece edge and a seam N. On the side of needle 3 opposite guide arm 10 is arranged the pressure stamp 15 formed by the piston rod of the compressed air cylinder 14 which is secured over an angle support 13, onto head 1. Compressed air cylinder 14 has two pressure lines 16, 17 shown in FIG. 3. Its piston can thus receive compressed air from both sides alternately over a reversing valve 19.

In order to adjust the pressure of pressure stamp 15, compression spring 20 is arranged at the end of piston rod 15 projecting at the top from the housing of compressed air cylinder 14, whose initial stress can be varied by means of a knurled nut 21.

Figure 3:
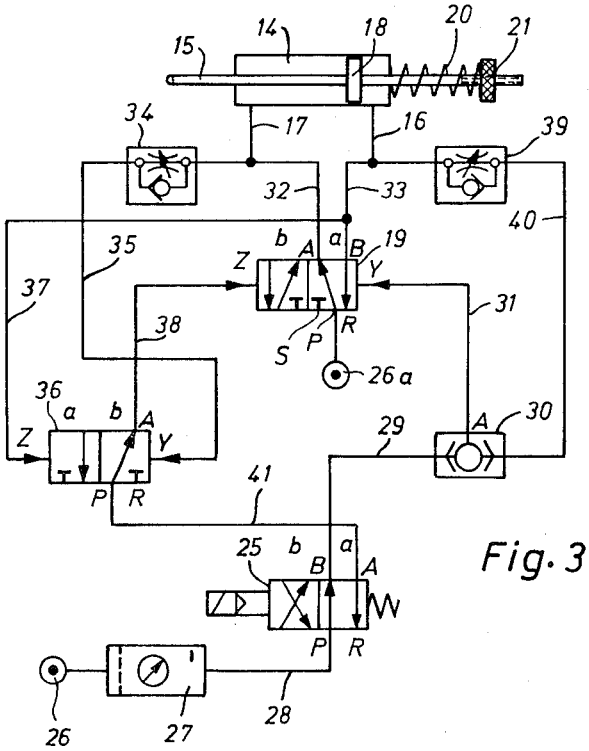
FIG. 3 is a pneumatic wiring diagram of an example for controlling and moving the pressure stamp.

A reflex-light barrier consisting of a transmitter 22 and a receiver 23 and secured on an angle support 24, serves to scan the outer edge of workpiece W and controls, in the example shown in FIG. 3, over a suitable amplifier circuit, a solenoid valve 25. Valve 25 is disconnected when the reflection surface on throat plate 5 of the sewing machine is covered by workpiece W and connected when the reflection surface is no longer covered by workpiece W. Solenoid valve 25 is held by spring force in switching position a, in which pressure line 28 connected with compressed air source 26 and following maintenance unit 27, is connected over pressure connection P, load connection B and a line 29 with output A of a two-way or double relief valve 30 acting as an OR-element.

Output A of two-way valve 30 is connected by a line 31 with control connection Y of reversing valve 19. Reversing valve 19 is held in switching position a by the generated compressed air. The compressed air is fed to one side of working piston 18 of compressed air cylinder 14, over the pressure connection P connected to a compressed air source *26a*, and load connection A of reversing valve 19, a pressure line 32, and line 17 connected to line 32. The other side of the piston is vented over lines 16 and 33 and connections B and R of reversing valve 19.

Pressure line 32 is connected over a throttle relief valve 34 and line 35 with control connection Y of a pulse valve 36, whose control connection Z is connected by a line 37 with line 33. The output A of pulse valve 36 is connected over a line 38 with control connection Z of reversing valve 19. In pressure line 33 is arranged a throttle relief valve 39, which is connected over a line 40 with the second input of two-way vlve 30. Finally pulse valve 36 is connected over line 41 with load connection A of solenoid valve 25, which is vented in switching position a, over a line of solenoid valve 25 and vent connection R.

Figure 4:
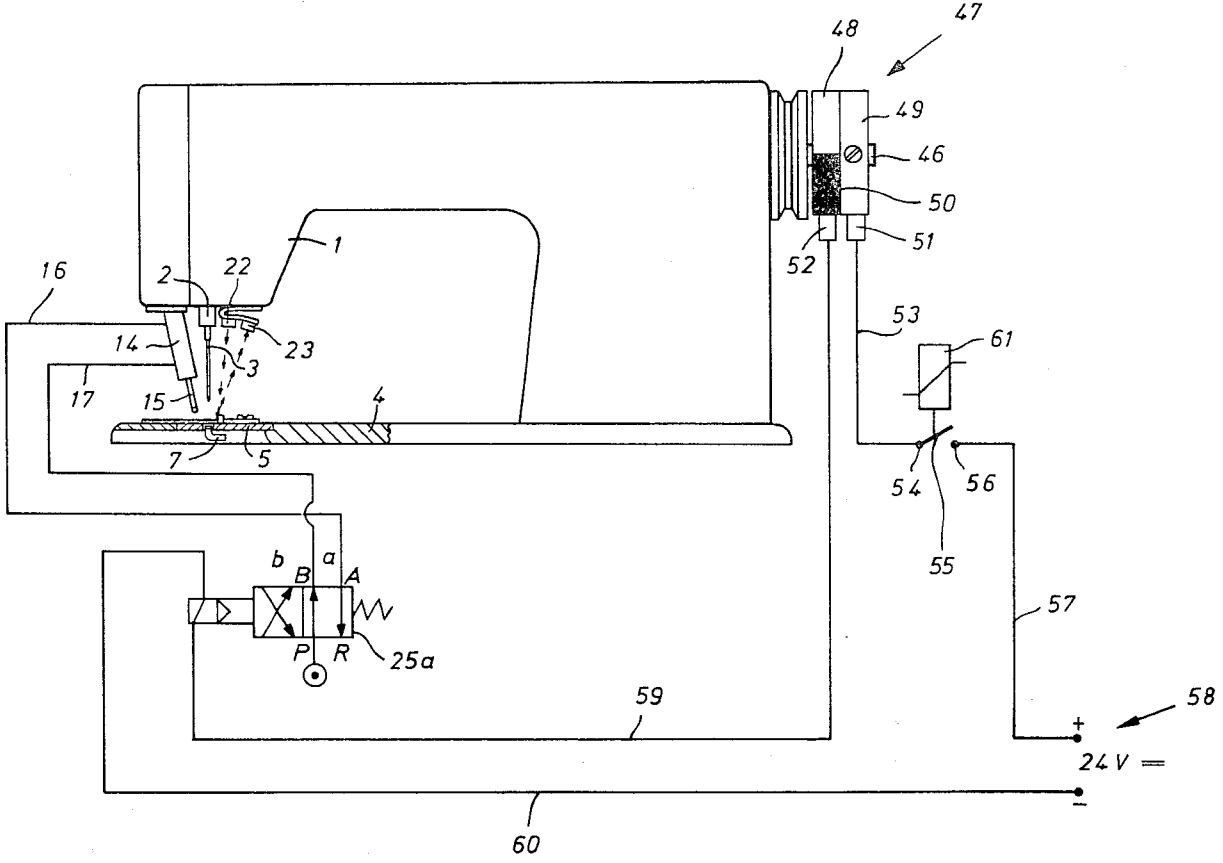
FIG. 4 is a side elevational view and schematic diagram of a second example for controlling and moving the pressure stamp.

In the example for controlling and moving pressure stamp 15 according to FIG. 4, a synchronizer 47 is arranged at the free end of arm shaft 46 of the sewing machine, which consists of two slip rings 48 and 49, of which slip ring 49 serves to supply the current. Slip ring 48 has an insulation zone 50 extending over 180° thereof. Slip ring 48 cooperates with a brush 52 and slip ring 49 with a brush 51. Brush 51 is connected by a line 53 with one contact 54 of a switch 55, whose other contact 56 is connected by a line 57 with the positive pole of a D.C. source 58. Brush 52 of slip ring 48 is connected by a line 59 with one side of the armature winding of a solenoid valve 25, whose other side of the armature winding is connected by a line 60 with the negative pole of D.C. source 58. Switch 55 is actuated by a relay 61, which is controlled over an amplifier circuit by reflex-light barrier 22/23.

Synchronizer 47 is arranged on main shaft 46 in such an angular position that the conductive segment of slip ring 48 is connected during the feeding phase of cloth feed 7 over brush 52 and line 59 with the armature winding of solenoid valve *25a*, so that solenoid valve 25*a* is connected in the feeding phase of cloth feed 7, provided contacts 54 and 56 of switch 55 are closed. This is the case when the light beam emitted from transmitter 22 is reflected by the reflection surface of throat plate 5 to receiver 23, and its photocell is constructed so that the scanning area is not covered by workpiece W. That is, when one of the arcs 42 to 45 approaches workpiece W, of stitch-forming area.

MODE OF OPERATION

Reflex-light barrier 22/23 forming a scanning device for the edge of the sewing material and controlling solenoid valve 25 or 25*a*, is so designed that solenoid valve 25 or 25*a* is disconnected in the darkened state hence when workpiece W is inserted under the presser foot with the starting point under needle 3 and interrupts the light beam emitted by sender 22, so that it does not reflect to receiver 23, and is held by spring action in switching position a. In this switching position, compressed air appears in the example of the control according to FIG 3, on control connection Y of reversing valve 19 over line 28 connected with compressed air source 26 and with maintenance unit 27, as well as pressure connection P, load connection B, line 29, two way valve 30 and line 31. Valve 19 thus assumes switching position a, in which one side of working piston 18 of compressed air cylinder 14 receives compressed air over pressure connection P and load connection A of reversing valve 19, and lines 32 and 17, so that pressure stamp 15 is lifted from workpiece W. The other side of working piston 18 of compressed air cylinder 14 is vented over lines 16, 33 and connection B and R of reversing valve 19. At the same time compressed air appears on control connection Y of pulse valve 36 over throttle relief valve 34 and line 35, which is this held in the represented switching position b in which control connection Z of reversing valve 19 is vented over lines 38, connection A and P of valve 36, line 41, and connections A and R of solenoid valve 25.

The sewing machine is switched on for the formation of the edge-parallel seam N (FIG. 2) by which a strip bordering the edge of workpiece W can be sewn on if needed. As soon as the edge of the sewing material releases the scanning point of edge scanner 22/23 in a convex course of the sewing material edge, e.g. as in 42, 43, 44 and 45 (FIG. 2), the light beam of transmitter 22, which is no longer interrupted, is reflected by and strikes the photocell of receiver 23, so that solenoid valve 25 is connected over an amplifier circuit and is brought into switching position b. In this switching position b the compressed air flow from pressure line 28 over pressure connection P and load connection A of solenoid valve 25 through line 41, over pressure connection P and connection A of pulse valve 36, which is in switching position b, and line 38, as well as control connection Z to the control piston of reversing valve 19. Valve 19 is thus moved into switching position b. The compressed air now appearing at pressure connection P of reversing valve 19 flows over connections P and B and lines 33 and 16 to the other side of working piston 18 of compressed air cylinder 14 and forces working piston 18 with pressure stamp 15, down with a pressure against workpiece W. This pressure can be adjusted by varying the initial stress of compression spring 20, so that a broken force is exerted on workpiece W at a lateral distance from needle 3. The first side of piston 18 of compressed air cylinder 14 is vented over lines 17, 32 and connections A and S of reversing valve 19. Together with the supply of compressed air over line 16 to the second side of working piston 18 of compressed air cylinder 14, compressed air flows over line 37 to the side Z of the control piston of pulse valve 36 and moves it into switching position a. In this switching position, the compressed air supply over control connection Z of pulse valve 19 is interrupted, and line 38 is vented over connection R of pulse valve 36, so that the pressure on control connection Z of valve 19 drops. At the same time, compressed air, adjustably delayed by line 33 over throttle relief valve 39, is fed to control connection Y of reversing valve 19 over line 40, two-way valve 30 and line 31. Reversing valve 19 is thus switched into switching position a. Compressed air is thus supplied briefly over load connection A and lines 32 and 17 to the first side of working piston 18, while the second side of the piston is vented over lines 16, 33 and connections B and R of reversing valve 19. The piston rod of compressed air cylinder 14 forming pressure stamp 15 is then lifted from workpiece W and pressure relieved. In switching position a of reversing valve 19 the control piston of pulse valve 36 is admitted, adjustably delayed, together with the compressed air supply over lines 32 and 17 over throttle relief valve 34, line 35, and control connection Y, and pulse valve 36 is thus displaced into switching position b. In this position, the compressed air pressure connection P of pulse valve 36 moves the control piston of reversing valve 19 into switching position b over its load connection A, line 38 and control connection Z. The supply of compressed air over connection A of reversing valve 19 and lines 32 and 17 to the first side of working piston 18 of compressed air cylinder 14 is thus interrupted, connection A of reversing valve 19 is vented over S, and the other side of working piston 18 is again admitted with compressed air over connection B of reversing valve 19 and lines 33 and 16, so that pressure stamp 15 is pressed immediately against workpiece W. This change in the direction of the compressed air, and thus the mutual admission of working piston 18 in rapid succession takes place as long as there is compressed air at the load connection A of solenoid valve 25, hence with solenoid valve 25 connected. The frequency of the movement of the piston rod of compressed air cylinder 14 forming pressure stamp 15 can be varied by adjusting throttle relief valves 34 and 39. This system forms thus an adjustable pulse generator for controlling the intermittently driven pressure stamp 15.

While pressure stamp 15 is pressed intermittently against workpiece W and brakes it, cloth feed 7 continues to work. Workpiece W is thus turned counterclockwise about pressure stamp 15. If the arc thus to be controlled has a radius which is greater than the distance between pressure stamp 15 and a guide edge of guide arm 10, the edge of the workpiece is pushed against the guide edge of guide arm 10, because pressure stamp 15 does not act in the center of the curvature of the arc, and would be raised on the latter. In the intervals between two pressure phases, workpiece W is pressure-relieved by pressure stamp 15. It can therefore yield to the left during its rotation, bearing on guide arm 10, under pressure stamp 15 transverse to the direction of feed arrow V, related to FIG. 2. This way a contour correct edge-parallel seam can be obtained, even with relatively thin and less stiff materials.

With equally good results a pulsating air current could replace pressure stamp 15 for the production of the braking force. This arrangement looks like FIG. 1 except without spring 20 and wheel 21 and with the air stream coming from the lower end of 15.

By interrupting the light beam emitted by transmitter 22 at the end of an arc, due to a position change of workpiece W, solenoid valve 25 is disconnected and moved again into switching position a under spring action. In this position, the control piston of reversing valve 19 receives, over control connection Y, compressed air supplied over connections P and B of solenoid valve 25, line 29, two-way valve 30, and line 31, and is moved into switching position a. The first side of working piston 18 of compressed air cylinder 14 receives air, over connections P and A of reversing valve 19 and lines 32 and 17, while the other side of working piston 18 is vented over lines 16 and 33 and connections B and R of reversing valve 19. Pressure stamp 15 is lifted from workpiece W.

If the beam of reflex-light barrier 22/23 is interrupted by workpiece W during the swing of the latter, switch 55 is open in the second example (FIG. 4) of the comtrol of the movement of pressure stamp 15, and solenoid valve 25*a* is thus disconnected. It is held in switching position a by spring force. In this switching position a, compressed air appears at pressure connection P over load connection B and line 17 on the first side of working piston 18 of compressed air cylinder 14, pressure stamp 15 is lifted from workpiece W, while the second piston side is vented over line 16 and connection A and R of solenoid valve 25*a*.

When one of the arcs 42 to 45 approaches the stitch-forming area and releases the beam emitted by transmitter 22, so that it is reflected from the reflection surface of throat plate 5 to receiver 23, striking its photocell, relay 61 is excited over an amplifier circuit, which closes contacts 54 and 56 of switch 55. As long as contacts 54 and 56 are closed, the circuit leading from the positive pole of D.C. source 58 over line 57, switch 55, line 53, brush 31, synchronizer 47, brush 52, line 59, over the armature winding of solenoid valve 25*a* to the negative pole of D.C. source 58 is closed during the revolution of the main shaft 46, when the conductive segment of slip ring 48 passes over brush 52 and is interrupted when insulation zone 50 of slip ring 48 passes over brush 52. With the circuit closed, solenoid valve 25*a* is thus connected, and assumes switching position b, while it is disconnected when the circuit is interrupted and is thus forced by spring force into switching position a. Solenoid valve 25*a* assumes thus at each revolution of main shaft 46 successively switching positions a and b, alternating in a rotation of 180°, namely switching position b in the feeding phase of cloth feed 7, which starts in needle feed-sewing machines approximately after the needle enters the cloth. It ends shortly before the needle leaves the cloth again. In this feeding phase of cloth feed 7, (switching position of solenoid valve 25*a*), the second side of working piston 18 of compressed air cylinder 14 is admitted over connections P and A of solenoid valve 25*a* and line 16 with compressed air, while compressed air-cylinder 14 is vented on the first side of working piston 18 over line 17 and connections B and R of solenoid valve 25*a*, so that pressure stamp 15 is pressed in the feeding phase of cloth feed 7 against workpiece W, which is thus braked. Workpiece W reserves thus a counterclockwise aligning movement about pressure stamp 15 by cloth feed 7 which is enhanced in needle feed-sewing machines by the needle.

During the rotation of main shaft by 180° following the feeding phase of cloth feed 7, solenoid valve 25*a* is disconnected and assumes switching position a. Compressed air cylinder 14 is thus vented on the second side of working piston 18 over line 16 and connection A and R of solenoid valve 25*a*, while the first side of working piston 18 is admitted with the compressed air supplied from the compressed air source over connections P and B of solenoid valve 25*a* and line 17, thus lifting pressure stamp 15 from workpiece W and relieving it of pressure. As described above, workpiece W which is pushed during its aligning movement with its edge against guide arm 10, can yield to the left with pressure stamp 15 lifted and pressure-relieved respectively, under the latter transverse to the direction of feed, arrow V, related to FIG. 2. Due to the intermittent movement of pressure stamp 15 adapted to the feeding phase of cloth feed 7, each aligning movement is followed by a yielding movement, so that an exact contour-correct control of arcs 42 to 45 is achieved.

By interrupting the beam of edge scanner 22/23 at the end of an arc, relay 61 is disconnected. Contacts 54 and 56 of switch 55 are thus opened, and solenoid valve 25*a* is disconnected. It it held in switching position a by spring force, in which the first side of working piston 18 of compressed air cylinder 14 is admitted over connections P and G and line 17, and compressed air cylinder 14 is vented on the second side of working piston 18 over line 16 and connections A and R. Pressure stamp 15 is therefore lifted from workpiece W.

At the end of the seam, the sewing machine stops in the raised position of the needle, independent of the control of the movement of pressure stamp 15, and workpiece W is removed, after cutting off the threads and the bordering ribbon, if any, and lifting the presser foot, after which the next workpiece is inserted and the above described cycle can start again.

While specific embodiments of the invention has been shown and described in detail to illustrate the application of the principles of the invention, it will be understood that the invention may be embodied otherwise without departing from such principles.

What is claimed is:

1. A mechanism in a sewing machine having a needle reciprocating in a needle path spaced from an edge guide for guiding an edge of a workpiece, for producing a curved edge parallel seam in the workpiece comprising:

workpiece feed means for feeding a workpiece past the needle path, with its edge guided along the edge guide;

edge scanning means for sensing when the workpiece edge moves away from the edge guide which is indicative of the presence of a curved workpiece edge area;

workpiece pressure means for applying pressure, when activated, to a point on the workpiece spaced laterally of the needle path to cause rotation of the workpiece about said point during feed of the workpiece by said workpiece feed means; and a control circuit connected to said workpiece pressure means and said edge scanning means for intermittently activating said workpiece pressure means a plurality of times when said edge scanning means senses the presence of a curved workpiece edge area.

2. A mechanism according to claim 1, wherein said workpiece pressure means comprises a pressure stamp and an activatable driver connected to said control circuit for moving said pressure stamp into contact with the workpiece at said point.

3. A mechanism according to claim 1, wherein said workpiece pressure means comprises an airstream blower for blowing an airstream against the workpiece at said point.

4. A mechanism according to claim 1, wherein said control circuit activates said workpiece pressure means independence of the reciprocation of the needle.

5. A mechanism according to claim 1, wherein said workpiece feed means feeds the workpiece intermittently, said control circuit activating said workpiece pressure means to apply a pressure to the workpiece at said point during the intermittent feeding of the workpiece by said workpiece feed means.

6. A mechanism according to claim 1, wherein said control circuit includes a pulse generator connected to said workpiece pressure means for intermittently activating said workpiece pressure means.

7. A mechanism according to claim 2, wherein said pressure stamp comprises a piston rod, said drive comprises a cylinder defining a chamber and slidably receiving a piston connected to said piston rod, and a spring engaged with said piston rod for exerting a variable and adjustable stress on said piston rod which is variable to vary a pressure exerted by said pressure stamp on the workpiece.

8. A mechanism according to claim 7, including a wheel threadably mounted to said piston rod, said spring being a compression spring positioned between said wheel and said cylinder, said wheel rotatable to move toward and away from said cylinder to vary the stress of said spring.

9. A mechanism according to claim 1, wherein said workpiece pressure means comprises a fluid activated piston and cylinder combination, a source of pressurized fluid, said control circuit comprising a solenoid valve having a first position for passing pressurized fluid to a first line to deactivate said workpiece pressure means and a second position for passing pressurized fluid to a second line for activating said workpiece pressure means.

10. A mechanism according to claim 9, wherein said control circuit further comprises the sewing machine including a main shaft, a pair of slip rings connected to said shaft, a bushing engaged with each slip ring, one of said slip rings including an insulated zone so that when said one slip ring is rotated to bring its insulated zone into contact with its respective bushing, an electrical connection is broken between said bushings, a first electrical line connected between said bushing of said one slip ring and a solenoid of said solenoid valve, a second electrical line connected between said solenoid and a source of electrical power, a third line connected between the other of said bushings and said source of electrical power, a switch in one of said lines connected to said edge scanning means for closing when said edge scanning means senses the presence of a curved workpiece edge area, said main shaft connected to said workpiece feed means and activating said workpiece feed means to feed the workpiece when said bushing of said one slip ring is out of contact with said insulating area whereby said workpiece pressure means is activated when said workpiece feed means feeds the workpiece.

11. A mechanism according to claim 9, wherein said control circuit further comprises a two-way relief valve connected to said first line having a pressure outlet and pressure inlet, a reversing switch having a first control port connected to said pressure output and a second control port, said reversing switch movable into a first position upon receiving pressure fluid from said first control port to supply pressure to said workpiece pressure means to deactivate said workpiece pressure means, a pulse valve having a first control port connected to said reversing switch for being pressurized with said reversing switch in its first position and a second control port, said pulse valve being movable under pressure in its first control port into a first position for applying pressure to said reversing switch second port, said solenoid valve second line connected to said pulse valve for supplying pressurized fluid to said pulse valve only with said solenoid valve in its second position, said reversing switch in its second position due to pressurization of its second port being operable to pressurize said pulse valve second port to move said pulse valve into a first position which depressurizes said reversing switch second port, and delay means connected between said reversing switch and said pulse valve first port and between said reversing switch and said two-way relief valve for adjustably delaying the switching of said pulse valve whereby said reversing switch is alternately moved between its first and second positions with said solenoid valve in its second position.

12. A method of automatically producing a curved edge parallel seam in a workpiece using a sewing machine having a reciprocating needle and edge guide comprising:

feeding a workpiece with its edge along the edge guide;

sensing the movement of the workpiece edge away from the edge guide which is indicative of the presence of a curved edge area; and applying an intermittent pressure to a point on the workpiece spaced from the needle during the feeding of the workpiece to cause a rotation of the workpiece about the point only when the workpiece edge is sensed as moving away from the edge guide.

* * * * *